United States Patent [19]

Belitzky

[11] 3,994,408

[45] Nov. 30, 1976

[54] INTERLOCKING CONTAINERS

[76] Inventor: Stanley Belitzky, 5350 MacDonald Ave., Montreal, Quebec, Canada

[22] Filed: July 2, 1975

[21] Appl. No.: 592,615

[52] U.S. Cl. ..... 215/10; 220/23.4

[51] Int. Cl.[2] ..... B65D 21/02

[58] Field of Search ..... 215/10; 220/23.4, 23.6; 206/504; 52/306, DIG. 9

[56] References Cited

UNITED STATES PATENTS

| | | | |
|---|---|---|---|
| 353,600 | 11/1886 | Sloan | 215/10 |
| 1,920,515 | 8/1933 | Marsden | 215/10 X |
| 3,374,917 | 3/1968 | Troy | 215/10 X |
| 3,767,203 | 10/1973 | Eaker | 215/10 X |

FOREIGN PATENTS OR APPLICATIONS

| | | | |
|---|---|---|---|
| 2,115,693 | 10/1972 | Germany | 206/504 |

*Primary Examiner*—Donald F. Norton
*Attorney, Agent, or Firm*—Alan Swabey & Co.

[57] ABSTRACT

The invention relates to an interlocking container which includes: a central body portion, a first arm extending outwardly from one portion of the central body, and a second arm extending outwardly from a second portion of the central body. The one arm comprises a shaped protrusion extending upwardly from one surface thereof and the second arm has a shaped depression in one surface thereof. In accordance with the invention, the protrusion and depression are matched for interlocking engagement, whereby a first one of the containers can be interlocked with at least a second one of the containers.

8 Claims, 2 Drawing Figures

INTERLOCKING CONTAINERS

BACKGROUND OF THE INVENTION

1. Field of the Invention

This invention relates to interlocking containers. More specifically, this invention relates to interlocking containers especially useful for reusable ice pack substitutes.

2. Description of the Prior Art

Interlocking containers, such as stackable and nestable containers, etc., are known in the art as is shown, for example, in U.S. Design Pat. No. 205,196, Wikke, July 5, 1966; U.S. Pat. No. 353,600, Sloan, Nov. 30, 1886; U.S. Pat. No. 1,920,515, Marsden, Aug. 1, 1933; U.S. Pat. No. 2,974,841, Van Leer, Mar. 14, 1961; U.S. Pat. No. 3,131,829, Masser, May 5, 1964; U.S. Pat. No. 3,323,668, Hills, June 6, 1967; U.S. Pat. No. 3,255,607, Bair et al., June 14, 1966; U.S. Pat. No. 3,338,452, Oakley et al., Aug. 29, 1967; and U.S. Pat. No. 3,583,590, Ferraro, June 8, 1971. However, none of the patented containers are in any way similar to the containers of the present application.

Reusable ice pack substitutes, also known as refrigerating apparatus, are also known in the art as is shown in U.S. Pat. No. 1,716,551, Hayes et al., June 11, 1929; and French Pat. No. 1,031,675, published June 25, 1953. However, the Hayes et al. patent relates to a plurality of such containers permanently fastened together for the purpose of providing a flexible arrangement, whereas the French patent relates to a shape for such containers which permits easy and space saving stacking of a plurality of such containers, but does not provide for the interlocking of such containers.

Thus, there remains outstanding in the art a problem as follows: with reusable ice pack substitutes as they are presently made, manufacturers of the ice pack substitute must produce a plurality of different size packs to meet the requirements of different sectors of the market. The consumer, on the other hand, will require several packs of different sizes from time to time, to meet his own differing requirements.

SUMMARY OF THE INVENTION

The solve these, and other problems, it is proposed, in accordance with the invention, to provide an ice pack substitute which is variable in size.

It is further proposed, in accordance with the invention, that the variable sized ice pack substitute comprise a plurality of individual containers, each container comprising means for interlocking the container with any other one of the containers.

Although the containers can be used as reusable ice pack substitutes, it will be appreciated that the invention is a readily usable with containers for other purposes as well.

In accordance with the invention, an interlocking container comprises:

a central body portion;

a first arm extending outwardly from one portion of said central body;

a second arm extending outwardly from another portion of said central body;

said one arm comprising a shaped protrusion extending upwardly from one surface thereof;

said second arm comprising a shaped depression in one surface thereof;

said protrusion and depression being matched for interlocking engagement;

whereby a first one of said containers can be interlocked with at least a second one of said containers.

Preferably, the arms extend from opposing portions of said central body.

In one embodiment, the central body is cubical, and the arms extend from opposing surfaces of the central body. In the one embodiment, the arms may extend laterally from side edges of the cubical body, each arm being of a thickness less than the thickness of the cubical body.

BRIEF DESCRIPTION OF THE DRAWINGS

The invention will be better understood by an examination of the following description, together with the accompanying drawings, in which.

DETAILED DESCRIPTION OF THE DRAWINGS

Figure 1:
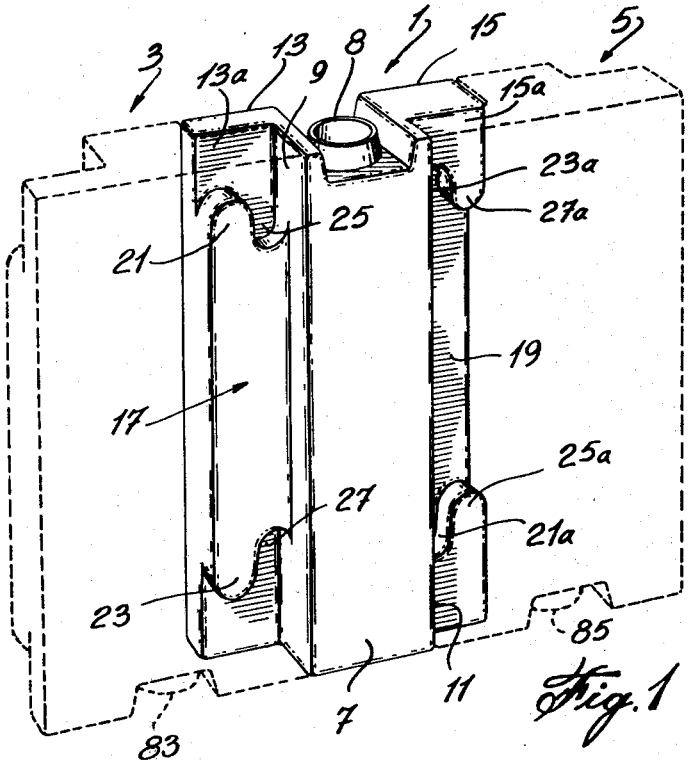
FIG. 1 is a perspective view showing several containers in interlocked engagement.

Referring now to FIG. 1, a first container 1 is shown in solid lines, and interlocking containers 3 and 5 are shown in dotted lines. In accordance with the invention, all containers are identical and comprise a central body portion 7 having a left side edge surface 9 and a right side edge surface 11. 8 is a cap for the container.

In the preferred embodiment, the central body portion 7 is substantially cubical in shape.

Extending outwardly from the left side surface 9 is a left arm 13, and extending outwardly from the right side surface 11 is a right arm 15. Disposed on, and extending upwardly from, surface 13a of arm 13 is a protrusion 17, while surface 15a of arm 15 comprises a depression 19. As can be seen, the protrusion 17 comprises tongues 21 and 23 for interlocking engagement with grooves **21*a* and 23*a* respectively of depression 19. The protrusion further comprises grooves 25 and 27 for interlocking engagement with tongues 25*a* and 27*a*, respectively, of the depression 19**.

In the preferred mode of practicing the invention, the tongues and grooves are of equal width, i.e., half the width of their respective arms, and the arms 17 and 19 are of equal width. It will, of course, be appreciated that deviations from these dimensional requirements can be easily made without departing from the spirit of the invention.

It is noted that the shape of the depression 19 is identical to the shape of the protrusion 17 except that the shape of the depression 19 is reversed about the transverse and longitudinal axis of the protrusion and depression. Thus, considering first the reversal about the longitudinal axis, the grooves 25 and 27 of the protrusion are disposed adjacent to side surface 9, whereas the tongues **25*a* and 27*a* of the depression are spaced from the side surface 11. In a like manner, the tonues 21 and 23 of the protrusion are spaced from the side surface 9 whereas the grooves 21*a* and 23*a* of the depression are disposed adjacent the side surface 11**.

Insofar as reversal about the transverse axis is concerned, in the preferred embodiment shown in the drawings, the shapes of both the protrusion and depression are symmetrical about their transverse axis. Thus, to illustrate the reversal, we will assume unsymmetrical shapes for these elements, and specifically we will assume that tongue 21, at the top of the protrusion, is triangular in shape, and that groove 23, at the bottom of the protrusion, is square shaped. With this arrangement, the tongue 21*a* of the depression, at the bottom of the depression, will be triangular in shape, and the groove 23*a*, at the top of the depression, will be square shaped. It can be seen, therefore, that the shapes are also reversed relative to each other about their transverse axis.

Thus, although the shapes of the protrusions and depression are identical, they are reversed, relative to each other, about their longitudinal and transverse axis in the illustrated embodiment.

Figure 2:
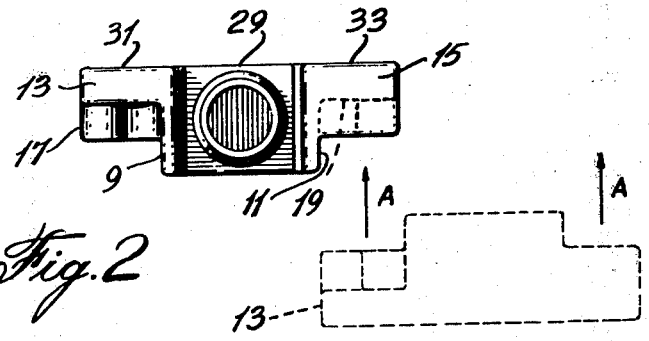
FIG. 2 is a top view of two containers showing how the containers are disposed into interlocking engagement.

The reason for this reversal can be seen when the process for disposing the containers into interlocking engagement is considered. In order to interlock two containers, it is necessary to first reverse one of the containers, relative to the other, about its transverse axis. As can be seen in FIG. 2, the front surfaces of both containers are now facing each other.

The arm 13 of the one container is now disposed adjacent the arm 15 of the other container, as shown in FIG. 2, and the containers are then moved towards each other. Because of the reversal in shapes, the protrusion on one of the containers will fit directly into the depression on the other container to interlock the containers.

The thickness of the arm 13 may be equal to substantially one third the thickness of the central body 7, and the height of the protrusion 17 may likewise be equal to substantially one third the thickness of the central body 7. The thickness of the arm 15 is equal to substantially two thirds the thickness of the central body 7, while the depth of the depression is equal to substantially one third the thickness of the body 7.

With these dimensions, as can be seen in FIG. 1, the front and rear surface of one container will be flush with the rear and front surfaces, respectively, of the other container so that the interlocked arrangement will comprise continuous front and rear surfaces.

In order to provide substantially continuous top and bottom surfaces for an interlocked arrangement, the lengths of the arms are made equal to the length of the central body 7.

In the drawings, the width of each arm 13 and 15 is equal to the width of the central body 7.

With this arrangement, a manufacturer can ship and sell the containers in packages containing a plurality of interlocked containers. Thus, the number of different sizes of containers which the manufacturer must produce is substantially reduced. The consumer who purchases the packages can now use as many interlocked containers, from one to the total plurality, as is required on any occasion, so that he no longer has to purchase a plurality of different sized containers for his different needs. In addition, the feature of having the containers interlocked to form a single unit, either in the package or in use by the consumer, is readily apparent.

The container may be made of a plastic material and formed as a single, integral unit.

Although a single embodiment has been illustrated and described above, many variations are possible in implementing the invention. Thus, although the rear surfaces of the arms are shown flush with the rear surface of the central body in the drawings, the arms could be made flush with the front surfaces instead, or, indeed, the arms could extend outwardly from the middle of the side edge. Of course, in the last mentioned arrangement, the front and rear surfaces of interlocked containers would not be continuous.

In addition, it is not necessary that the central body be cubical in shape if other shapes be necessary or desired, nor is required that the length of the arms be the same size as the length of the central body. Further, it is not necessary that the arms extend from side surfaces. They could, instead, extend from the front and rear surfaces or from the top and bottom surfaces.

In a further arrangement, it would be possible to have the arm with the depression disposed so that the front surface thereof is flush with the front surface of the central body. The depression would, with such an arrangement, be disposed on the rear surface of the depression bearing arm, and the shape of the depression would be reversed about the longitudinal axis relative to the shape of the protrusion, but would be reversed about the transverse axis. With this arrangement, the caps of all the interlocked containers would be on the top surface of the interlocked arrangement.

Thus, although one embodiment was described in the above, this was for the purpose of illustrating, but not limiting, the invention. Various other modifications, which will come readily to the mind of one skilled in the art, are within the scope of the invention as defined in the appended claims.

I claim:

1. An interlocking container comprising:

a central body portion in the shape of a right rectangular prism having first and second opposing sides disposed in parallel to each other;

a first arm extending outwardly from said first side of said central body;

a second arm extending outwardly from said second side of said central body;

said first arm comprising a shaped protrusion extending upwardly from one surface thereof;

said second arm comprising a shaped depression in one surface thereof;

said protrusion and depression being matched for interlocking engagement;

whereby a first one of said containers can be interlocked with at least a second one of said containers.

2. An interlocking container as defined in claim 1 wherein the rear surfaces of said arms being continuous with the rear surface of said central body;

the thickness of said first arm being substantially one third the thickness of said central body;

the height of said protrusion being substantially one third the thickness of said central body;

the thickness of said second arm being substantially two thirds the thickness of said central body; and the depth of said depression being substantially one third the thickness of said central body;

whereby, when a plurality of said containers are interlocked to form an interlocking arrangement, the front and rear surfaces respectively of the arrangement are continuous.

3. An interlocking container as defined in claim 2 wherein said protrusion comprises a pair of first tongues, each one of said tongues being spaced from said central body by respective ones of a pair of first grooves disposed adjacent the one side of said central body, the width of said first grooves being equal to the width of said first tongues;

and wherein said depression comprises a pair of second grooves disposed on said second arm adjacent the second side of said central body, said second arm further comprising a pair of second tongues, each of said tongues being spaced from said second side of said central body by the respective ones of said second grooves, the width of said second tongues being equal to the width of said second grooves;

the width of said first tongues being equal to the width of said second grooves.

4. An interlocking container as defined in claim 1 wherein the width of said first arm is equal to the width of said second arm.

5. An interlocking container as defined in claim 1 wherein the length of each aid arm is equal to the length of said central body.

6. An interlocking container for reusable ice pack substitutes comprising:

a substantially rectangular central body;

a first substantially rectangular arm, equal in length to the length of said body, and equal in thickness to one third the thickness of said body, extending from one side of said cubical body;

a protrusion extending upwardly from a surface of said first arm, the height of said protrusion being one third the thickness of said central body;

a second substantially rectangular arm, equal in length to the length of the central body, and equal in thickness to two thirds of the thickness of the central body extending from an opposing side of said central body;

a depression in a surface of said second arm having a depth equal to one third the thickness of said central body;

the widths of said arms being equal to each other;

said protrusion and depression being matched for interlocking engagement;

whereby a first one of said containers can be interlocked with at least a second one of said containers.

7. A container as defined in claim 6 wherein the rear surfaces of said arms are continuous with the rear surface of said central body.

8. A container as defined in claim 6 wherein;

the rear surfaces of said arms being continuous with the rear surface of said central body;

the thickness of said first arm being substantially one third the thickness of said central body;

the height of said protrusion being substantially one third the thickness of said central body;

the thickness of said second arm being substantially two thirds the thickness of said central body; and the depth of said depression being substantially one third the thickness of said central body;

whereby, when a plurality of said containers are interlocked to form an interlocking arrangement, the front and rear surfaces respectively of said containers are continuous.

* * * * *

UNITED STATES PATENT OFFICE
CERTIFICATE OF CORRECTION

PATENT NO. : 3,994,408

DATED : November 30, 1976

INVENTOR(S) : Stanley Belitzky

It is certified that error appears in the above-identified patent and that said Letters Patent are hereby corrected as shown below:

Title page after:

" [76] Inventor: Stanley Belitzky, 5350 MacDonald Ave., Montreal, Quebec, Canada"

Insert:

--[73] Assignee: Stanbel B.V., Zwaanshoek, Gemeente Haarlemmermeer, Netherlands--

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*